United States Patent [19]

Bolton

[11] 4,272,071

[45] Jun. 9, 1981

[54] WALKER APPARATUS

[76] Inventor: Barbara A. Bolton, 101 NE., 11th St., Moore, Okla. 73160

[21] Appl. No.: 33,160

[22] Filed: Apr. 25, 1979

[51] Int. Cl.[3] ..... A61H 3/04

[52] U.S. Cl. ..... 272/70.4; 135/67

[58] Field of Search ..... 135/67, 65; D12/128, D12/130; 272/70–70.4; 297/5, 6

[56] References Cited

U.S. PATENT DOCUMENTS

| | | | |
|---|---|---|---|
| D. 240,214 | 6/1976 | Allen | D12/130 |
| 320,462 | 6/1885 | Cowing | 272/70.3 |
| 2,591,912 | 4/1952 | Block | 272/70.3 |
| 2,634,790 | 4/1953 | Elle | 135/67 |
| 3,195,550 | 7/1965 | Ingalls et al. | 135/67 |
| 3,272,530 | 9/1966 | Klassen | D12/128 X |
| 3,516,425 | 6/1970 | Rigal | 135/67 |
| 3,596,668 | 8/1971 | Tosto | 135/67 |
| 3,716,067 | 2/1973 | Skoog | 135/67 |
| 3,844,554 | 10/1974 | LaMontagne | 272/70 X |
| 4,086,932 | 5/1978 | Richardson | 135/67 |

FOREIGN PATENT DOCUMENTS

| | | | |
|---|---|---|---|
| 1491561 | 10/1969 | Fed. Rep. of Germany | 272/70.3 |
| 2374871 | 8/1978 | France | 135/67 |
| 4488 | of 1901 | United Kingdom | 272/70.3 |
| 978587 | 12/1964 | United Kingdom | 272/70.3 |

*Primary Examiner*—J. Karl Bell

*Attorney, Agent, or Firm*—William R. Laney

[57] ABSTRACT

A walker apparatus is disclosed which includes a support structure which extends substantially from the ground to the underarms of the user and encloses the user. The support structure includes a number of horizontally disposed ring members which are vertically separated by a plurality of struts and are pivotally connected to a longitudinally extending axial member. The support structure also includes a locking mechanism which is disposed at the upper front of the support structure. The walker apparatus also includes hand grips or, alternatively, crutches which extend from the uppermost ring member to the floor.

4 Claims, 11 Drawing Figures

WALKER APPARATUS

BACKGROUND OF THE INVENTION

1. Field of the Invention

This invention relates generally to walker apparatus and more particularly, but not by way of limitation, to substantially body-length walker apparatus for people who have walking disabilities.

2. Description of the Prior Art (Prior Art Statement)

The following statement is intended to be a prior art statement in compliance with the guidance and requirements of 37 C.F.R. 1.56, 1.97 and 1.98.

U.S. Pat. No. Des. 240,214 issued to Allen discloses an invalid's walker having two substantially circular members which are displaced a fixed vertical distance from each other by a plurality of inwardly inclining longitudinal members. The circular members are proposed to be pivotal about an axis extending longitudinally along the front of the walker. When these members are pivoted to the rear in a closed fashion whereby the members are in their substantially circular configuration, both the upper and lower circular members are disclosed to be locked at the rear. This patent further discloses that the walker apparatus is to be supported by four wheels or casters. What appear to be two vertically adjustable hand grips or rests are also shown.

U.S. Pat. No. 3,195,550 issued to Ingalls et al discloses another type of walking device. This device includes two semi-circular horizontal members which are vertically separated by a plurality of fixed length rods. The lower semi-circular member is supported by a plurality of rollers. Attached to the upper semi-circular member are two crutch-like supports. These supports are both horizontally and vertically adjustable with respect to the member to which they are attached. Another patent which discloses apparently crutch-like members is U.S. Pat. No. Des. 181,957 issued to Callahan.

Still another type of walker is disclosed in U.S. Pat. No. 3,354,893 issued to Schmerl. The proposal of this patent includes a three-sided frame having four legs. The front two legs terminate in rubber members. The rear two legs terminate in roller elements. Also included in the frame are two hand grips. Another patent which discloses a walking aid which includes frictionally engagable material for contacting the surface on which the aid is used is U.S. Pat. No. 2,847,057 issued Holcombe. This proposal also includes a pair of handle bars, each of which is connected to the opposite end of the vertical member to which the frictionally engagable material is attached. In addition to these two patents, U.S. Pat. No. 2,792,874 issued to Sundberg proposes a walker device having brake shoes which automatically grip the supporting surface when an undue force is applied to the upper structure. The undue force may be transmitted through a set of handle bars which are also included in the proposal.

Still other types of walkers are disclosed in U.S. Pat. No. 3,993,088 issued to Thomas, U.S. Pat. No. 3,516,425 issued to Rigal, and U.S. Pat. No. 1,448,783 issued to Blewitt et al. The Thomas patent proposes a device having a three-sided foldable frame. This frame includes a plurality of legs which may be telescoped to provide vertical adjustment. This device is also proposed to include hand grips at the upper extremities of the device and foot pads at the lower extremities of the device. The Rigal patent also discloses a walker which includes members capable of height adjustment. This apparatus is also proposed to be foldable and to include a plurality of rubber feet. Finally, the Blewitt patent also discloses a structure having legs which may be adjusted to vary the height of the apparatus.

As is apparent from these cited references, there is a need for walker apparatus to assist those who have walking disabilities to be more mobile. However, these references have shortcomings in that they fail to propose solutions to other needs of the people who use the walker apparatus. For example, the cited references fail to disclose a support structure which extends all the way from the floor to the underarms of the user. Such an elongated structure is necessary to provide the invalid with the necessary support and stability to adequately and safely move about.

Another shortcoming of the cited references is the failure to disclose an apparatus which encloses the user within a structure having an easily accessible locking means positioned at the front upper region of the structure. Such a structure and locking means is necessary to safely support the user and yet be easily openable by such user without the aid of another person or without the need of turning around.

Still another shortcoming of the above references is their failure to propose a structure for supporting a paraplegic in an upright position and for providing such person who does not have the use of the lower portion of his body with a means of upright locomotion. In particular, the cited references fail to disclose a structure having floor-length crutch members combined with a support structure. Certainly such a walker apparatus is needed by those persons who do not have the lower body strength to support themselves or to ambulate.

A further example of the shortcomings of the prior references is their failure to disclose a support structure having handles which extend forwardly thereof to positions which coincide with the natural location of the hands of an infant who is holding on to or pushing an object in front of him. Such a feature is needed to permit infants who have walking disabilities to easily use a walker apparatus.

In light of these disadvantages Applicant believes that no previously disclosed device which is known to her indicates, either singly or in combination, the present invention.

SUMMARY OF THE INVENTION

The present invention overcomes the above-noted and other shortcomings of the prior art by providing a novel, useful and improved walker apparatus. In particular the present invention provides a walker apparatus which extends substantially the entire length from the floor, or other support surface, to the underarm region of the user. Additionally, the inventive walker structure which is pivotable about a longitudinal axis may be locked in its closed position by means of an easily accessible locking means positioned at the front upper region of the structure. Also, in one embodiment of the present invention the walker structure includes a pair of crutch-like members which extend from the upper part of the walker down to the floor thus providing a means of locomotion powered by the user's upper body muscles. One further inventive feature of the present invention is the pair of handles connected to the front of the walker and extending forwardly thereof for the placement of an infant's hands held in a natural position for pushing an object.

The walker apparatus of the present invention includes a support structure made up of first and second frameworks which are pivotally joined along a common longitudinal axial member. The frameworks are curvilinear in nature so that they may be pivoted toward each other to a closed position thereby defining a circular cross-sectional configuration of the support structure. The support structure further includes a locking means located near the front upper portion of the support structure for easy manipulation by the user of the walker apparatus. This locking means is also located proximate the longitudinal axial member which defines the front of the walker.

The walker also includes stabilization and movement means such as frictional and roller elements. These means are connected to the lower portion of the support structure and thereby separate the support structure from the floor, or placement surface on which the walker apparatus is placed.

The walker additionally includes a plurality of hand grips which may in one embodiment be disposed within the support structure intermediate the upper and lower portions thereof. Alternatively, the hand grips may extend forwardly from the support structure so that an infant may grab them in the natural manner of grasping a thing which he is to push.

Still further, the walker apparatus of the present invention includes, in one embodiment, a pair of crutch members which are connected to the upper portion of the support structure and extend to a length which is sufficient to permit the other ends of the crutch members to engage the surface on which the walker is placed.

To operate the apparatus, the person with the walking disability stands to the rear of the support structure, grasping a respective one of the frameworks in each of his hands. The user then pivots the frameworks away from him to their open position. The support structure is then drawn toward the user (or the user steps toward the walker) and the frameworks are pivoted back toward each other to the closed position. With the frameworks closed upon each other, the user then secures them by latching the locking means. The walker apparatus thus encloses the user. Because of the height of the apparatus, the user is secured within the support structure in an erect position with the upper portion of the support structure placed beneath the underarms of the user. Ambulation can then occur either by the user's leg power in walking or his arm power in utilizing the crutches.

From the foregoing, it is a general object of the present invention to provide a novel, useful and improved walker apparatus for persons having walking disabilities. Other and further objects, features and advantages of the present invention will be readily apparent to those skilled in the art upon a reading of the description of the preferred embodiments which follow when taken in conjunction with the accompanying drawings.

DETAILED DESCRIPTION OF PREFERRED EMBODIMENTS OF THE INVENTION

Figure 1:
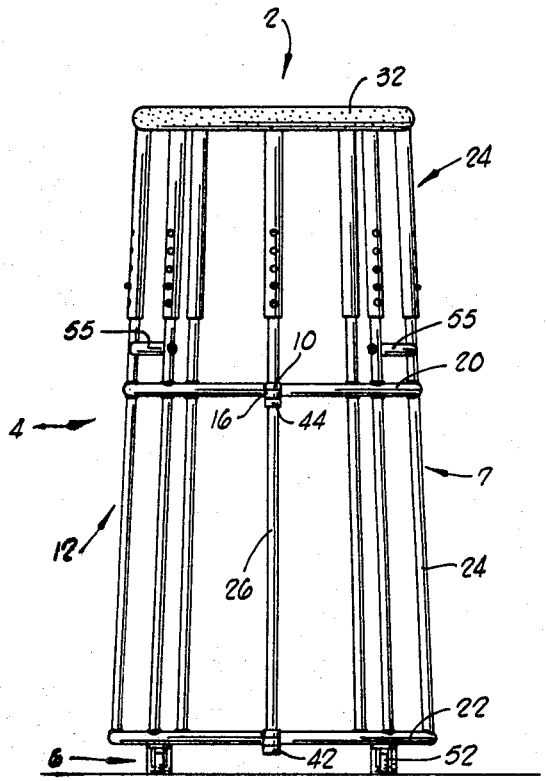
FIG. 1 is a front elevation view of a first preferred embodiment of the present invention.

Referring now to the Figures, and in particular to FIGS. 1–5, a walker apparatus 2 constructed according to the present invention will be described. In general the walker apparatus 2 includes a support structure 4 and a stabilization and movement means 6.

The support structure 4 includes a first framework 7 having a first front edge 8 and a first joining, or hinging, means 10. The support structure 4 also includes a second framework 12 having a second front edge 14 and a second joining, or hinging, means 16.

The first and second frameworks include a plurality of structural members, which include ring members 18, 20, and 22, strut members 24, and an axial member 26, and a locking means 27. The structural members may be made of a light-weight sturdy material, or any other suitable material, which, when constructed according to the present invention, is capable of supporting the weight of the user of the apparatus.

Figure 2:
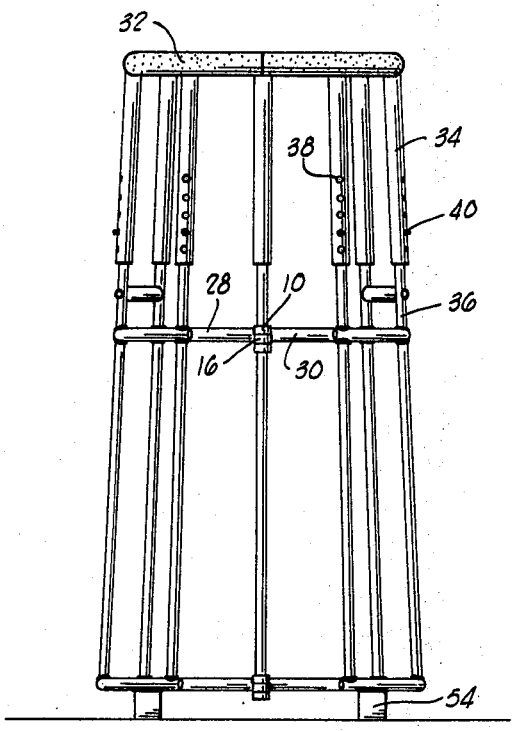
FIG. 2 is a rear elevation view of the first preferred embodiment of the present invention.
Figure 3:
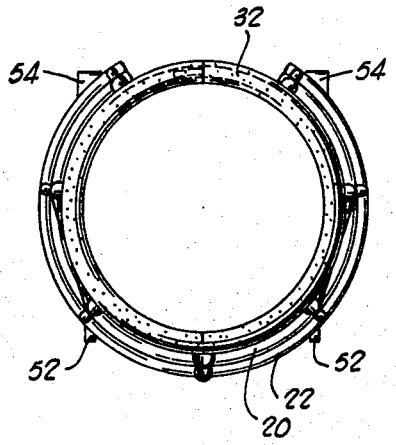
FIG. 3 is a top plan view of the first preferred embodiment of the present invention.

The ring members include an uppermost ring member 18, an intermediate ring member 20, and a lowermost ring member 22. Each of these ring members includes a first curvilinear element 28 and a second curvilinear element 30. Each of these curvilinear elements has connected to one end thereof one of the joining means 10 or 16. As shown in FIGS. 1 and 2, these joining means may be an annular sleeve element which is connected to the respective curvilinear element and placed over the axial member 26. Also associated with the uppermost ring member 18 is a cushioning collar, or pad, 32 which is made of a cushioning material such as foam rubber. This pad 32 is placed around the uppermost ring member 18 for the comfort of the user of the walker apparatus 2. Also connected to the uppermost ring 18 is the locking means 27 which will be more fully described hereinbelow.

In the preferred embodiments described herein, these ring members have different sized diameters when they are in their closed positions. The lowermost ring member 22 has the largest diameter and the uppermost ring member 18 has the smallest diameter. By arranging these diametrically different ring members in this way (i.e., ascending from largest to smallest diameter) and interconnecting the ring members with straight strut members 24, a stable support structure which has, in its closed position, the shape of a truncated cone is obtained. In other words, a shape having a substantially circular cross-section is defined. Certainly other sized elements could be used to obtain structures having different shapes. Furthermore, in the preferred embodiments these ring members are horizontally disposed in parallel relation to each other. Also they are vertically separated and laterally oriented in concentric relationship to each other as shown in the Figures.

The strut members 24 include both the lower, fixed length struts and the upper, variable length struts depicted in the drawings. Each of the lower struts are connected at one end to the lowermost ring member 22 and at the other end to the intermediate ring member 20. Because of the smaller diameter of the intermediate ring member 20, these lower struts incline inwardly. As shown in FIG. 2 each of the variable length struts include an outer telescoping element 34 and an inner telescoping element 36. One end of each outer element 34 is connect to the uppermost ring member 18; the other end of each extends over the respectively associated inner element 36. Defined within the outer telescoping element 34 are a plurality of vertically spaced holes 38. Each inner element 36 has one end connected to the intermediate ring member 20 and the other end inserted within the respectively associated outer element 34. Connected to the inner telescoping element 36 is a latching means 40. In the preferred embodiment disclosed in the Figures, the latching means 40 is a spring-loaded pin which is depressed to permit the outer telescoping element 34 to telescope up or down along the inner telescoping element 36. When the appropriate height is established, the latching means 40 is permitted to protrude through the appropriate hole 38 under pressure of the spring which is a part of the preferred embodiment latching means 40. It is apparent that any suitable means of height adjustment and latching means may be used.

The axial member 26 provides a longitudinally extending axis about which the two frameworks 7 and 12 can pivot. One end of the axial member 26 terminates in an end collar 42 upon which the joining means 16 of the lowermost ring member 22 rests. The axial member also includes an intermediate collar 44 against which the joining means 16 of the intermediate ring member 20 rests. Resting upon the respective joining means 16 are the respectively associated joining means 10. The upper portion of the axial member 26 terminates in a telescoping combination similar to those of the upper strut members 24. Thus, this axial member is a connecting means for the curvilinear elements of the ring members. This axial member also defines the front of the support structure and provides a pivotation axis common to all of the ring members.

Figure 4:
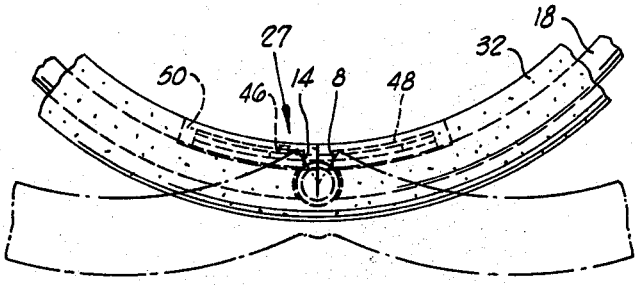
FIG. 4 is an enlarged top plan view of a portion of the uppermost ring member of the present invention.

The locking means 27 connected to the uppermost ring member 18 includes a bolt member 46 and a sleeve member 48, each connected to a respective one of the curvilinear elements 28 and 30 of the ring member 18. This locking means 27 is disposed within a recessed area 50 of the cushioning collar 32. From the FIG. 4 depiction one will see that when the walker apparatus is in its closed position wherein the ring members are in their subtantially circular configurations, this position is secured by moving the bolt member 46 across the axial member 26 for engagement with the sleeve member 48. This locking action prevents the support structure 4 from pivoting outwardly along the axial member 26. When the bolt member 46 is not in engagement with the sleeve member 48, the walker apparatus may be positioned in its open configuration by pivoting the frameworks 7 and 12 outwardly about the axial member 26. This is shown in FIG. 4 by the dashed-line drawing. It will be apparent to one having ordinary skill in the art that any proper locking means may be used to secure the walker apparatus in its closed configuration.

In the preferred embodiment depicted in FIGS. 1–5, the stabilization and movement means 6 includes a pair of rollers 52 and a pair of skids 54. The rollers 52 permit the walker apparatus to be easily moved when it is tilted slightly forward by the user when the user desires to proceed. The skids 54 permit the walker apparatus to be stabilized during those periods when the user does not wish to proceed by frictionally engaging the surface upon which the walker is placed.

Figure 5:
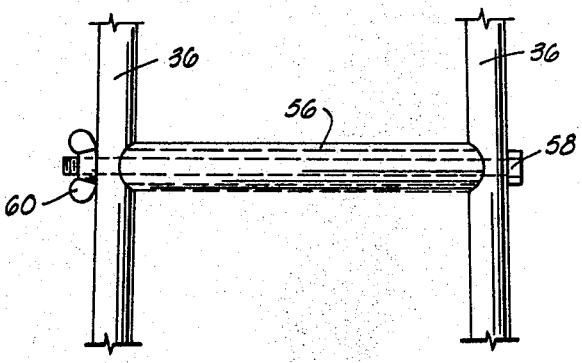
FIG. 5 is an enlarged view of a first preferred embodiment hand grip of the present invention.

In addition to the above-described elements, the embodiment shown in FIGS. 1–5 also includes first and second hand grips 55. FIG. 5 depicts a preferred embodiment of these hand grips. In this preferred embodiment the hand grip includes a handle 56 disposed between adjacent inner telescoping elements 36 and secured thereto by means of a bolt 58 extending through the two elements 36 and the handle 56 and threadedly engaging a securing means 60, such as a wing nut.

With reference now to FIGS. 6–10, a second preferred embodiment of a walker apparatus constructed according to the present invention will be described. This embodiment includes similar elements such as the first and second frameworks 7 and 12, the ring members 18, 20, and 22, the strut members 24, and the axial member 26. The walker apparatus also includes the stabilization and movement means 6. However, this embodiment includes within its support structure 4 a footplate member 68 and first and second crutch members 74 in place of the hand grips 55.

Figure 10:
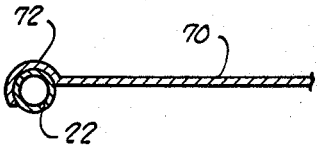
FIG. 10 is an enlarged sectional elevation view of the footplate of the second preferred embodiment of the present invention.

The plate 68 includes a substantially flat portion 70 which terminates at two diametrically opposed edges in shoulder regions 72. These shoulder regions 72 are formed to removably fit over any one of the ring members as shown in FIG. 10. Because the ring members are of differing diameters, the plate 68 must be so formed to accomodate a secure fit with each one. For example, the plate 68 must be able to fit over the lowermost ring member 22 when the walker apparatus is to be used by a person who has legs. However, if the walker apparatus is to be used by one who has had his legs amputated, for example, the plate 68 must be able to fit over the intermediate ring member 20. The plate 68 may be made of any suitable material which can support the weight of the user.

The first and second crutch members 74 are shown connected to substantially diametrically opposite locations on the underside of the uppermost ring member 18. The connections are made through a connector means 76 to which is connected a frame 78. Extending from the end of the frame 78 opposite that end connected to the connector means 76 is a leg 80. This leg 80 terminates in a tip cover 82 which frictionally coacts with the placement surface upon which the walker apparatus is used. The crutch member 74 also includes a hand grip 84 disposed between spatially separated portions of the frame 78.

Figure 9:
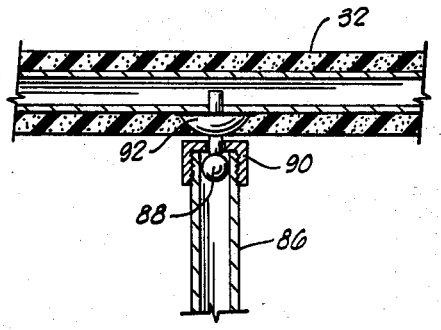
FIG. 9 is an enlarged sectional view of the connection between the support structure and crutch member of the present invention.

With reference now to FIG. 9, the connector means 76 will be more fully described. The preferred embodiment connector means 76 shown in this Figure includes a hollow tubular member 86. It is to this member that the frame 78 is connected. Extending into the hollow interior of the tubular member 86 is a spherical member 88 which depends from and is secured to the ring member 18. Placed over the end of the tubular member 86 and the spherical member 88 is a cap 90 which is threadedly connected to the tubular member 86 for retaining the spherical member 88 therein. The cap 90 has an opening through which the elongated portion of the spherical member 88 extends to its connection with the ring member 18. This opening permits the crutch member to be pivotable about the spherical member 88. Also associated with the spherical member 88 is a hemispherical element 92 connected to the ring member 18. This element 92 also permits pivotation of the crutch member 74. It is through this type of connection with the support structure 4 that the crutch member 74 permits locomotion to the walker apparatus. It will be apparent to those having skill in the art that other suitable means which permits universal pivotation of the crutch may be used.

Figure 11:
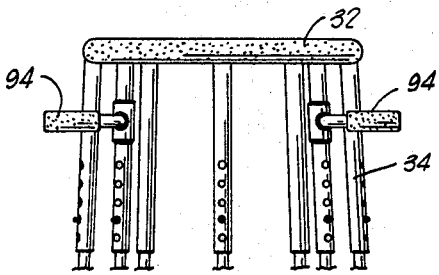
FIG. 11 is an enlarged view of the forwardly extending hand grip embodiment of the present invention.

With reference now to FIG. 11 a handle 94 which may be used in place of the hand grips 55 is shown. The handle 94 extends forwardly from the support structure 4 at an angular relationship thereto. These are placed at a position at which an infant would place his hands thereon in a normal position to push the walker apparatus. Therefore, it is apparent that the present invention may be used by all ages of people having walking impediments.

To operate the present invention, a user opens the walker by pivoting the first and second frameworks 7 and 12 outwardly along the axial member 26. The user then draws the apparatus toward himself (or he walks toward the open apparatus) and pivots the frameworks back around him thus positioning the support structure in its truncated cone, or substantially circular cross-section, configuration. With the support structure enclosing him, the user next manipulates the locking means 27 to rigidly secure the support structure in its closed position. The user is now securely supported by the walker apparatus. To move forward the user grasps the hand grips 55 and slightly tilts the structure forward so that it may be moved on its rollers 52. When the user does not desire to move, he simply releases any forward tilting of the structure so that it rests on its skids 54. The skids 54 frictionally engage the placement surface on which the walker is located to prevent movement of the walker.

When the height of the structure is to be varied to accommodate the height of the particular user, the upper strut members 24 are telescopically moved so that the support structure 4 extends substantially the entire length from the placement surface to the underarm area of the user. This permits the cushioning collar, or pad, 32 to comfortably engage or support the user. Having the present invention extend upward to the underarms of the user permits the user to move about in a substantially erect posture.

Figure 6:
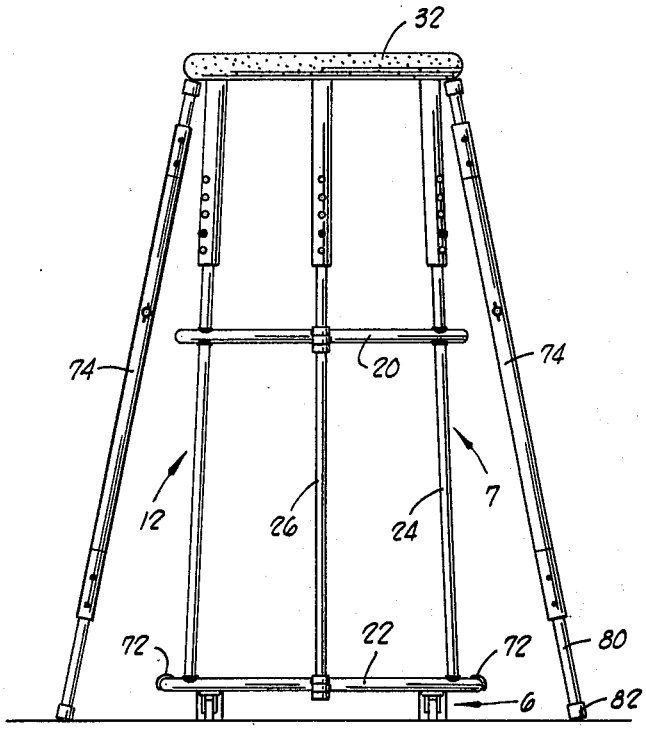
FIG. 6 is a front elevation view of a second preferred embodiment of the present invention.
Figure 8:
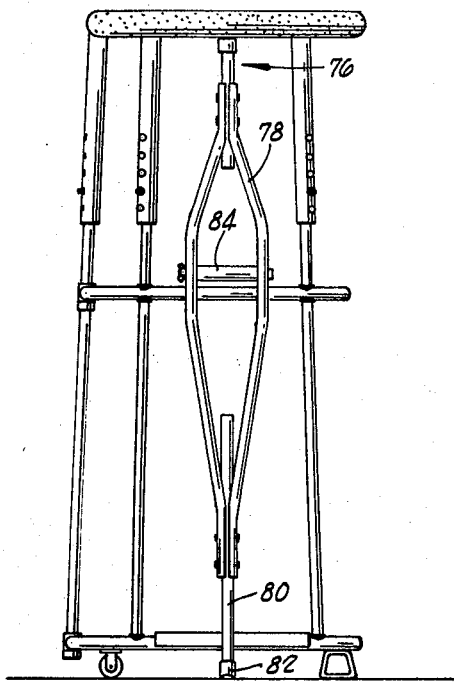
FIG. 8 is a side elevation view of the second preferred embodiment of the present invention.
Figure 7:
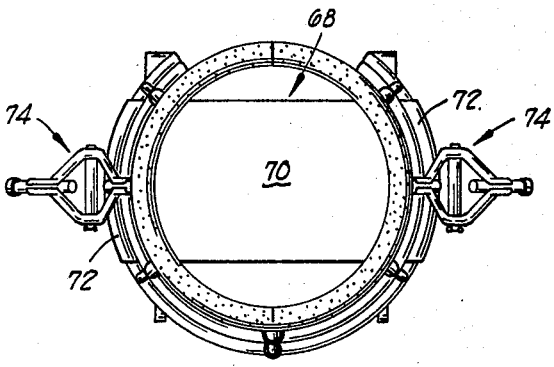
FIG. 7 is a top plan view of the second preferred embodiment of the present invention.

The second preferred embodiment disclosed in FIGS. 6–8 is used in a manner similar to that of the first preferred embodiment. However, with this apparatus, a person that has only the use of his arms, for example, may provide his own means of locomotion while supporting himself in an upright position. This is accomplished by first adjusting the height of the support structure to coincide with the underarm height of the user. Once this is accomplished and the user is placed within the walker apparatus as described above, he is supported on the upper ring 18 and its associated pad 32. In this position the user may then utilize the crutch members 74 to move the walker apparatus forward. This is done by grasping the handles 84, swinging the crutch members 74 outwardly and forwardly, and then pulling the support structure forwardly. Alternatively, the crutch members 74 may be placed to the side and the support structure then pushed forward, as opposed to being pulled forward. Regardless of the exact method used, it is apparent that this structure permits a person to move himself under power provided only by his arms.

Thus, the present invention of a walker apparatus is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A walker apparatus for assisting a person who has a walking disability to move about in a substantially erect posture and by means of that person's own strength, comprising:

a support structure having a plurality of structural members interconnected to define a shape approximating a truncated cone, said support structure having a height which is vertically adjustable to extend from a region near the surface on which said support structure is placed to the underarms of said person using said walker, said structural members including:

a plurality of horizontally disposed ring members, each having first and second curvilinear elements interfacing at joining means for providing pivotation about an axis common to all said ring members;

a plurality of strut members interconnected between respective ones of said curvilinear elements of said ring members to concentrically orient and vertically separate said ring members thereby establishing a lowermost ring member and an uppermost ring member; and an axial member associated with said joining means of each ring member and extending from said lowermost ring member to said uppermost ring member longitudinally along the forward portion of said walker apparatus for providing said common axis; and means for aiding the stabilization and movement of said support structure, said means being connected to one of said structural members at said region near the surface on which said support structure is placed and extending from said structural member to said surface.

2. A walker apparatus as recited in claim 1, wherein:

said strut members include:

a plurality of outer telescoping elements; and a plurality of inner telescoping elements slidably associated within, but extending outwardly from, said outer telescoping elements; and said axial member including:

an outer element; and an inner element telescopically associated with said outer element.

3. A walker apparatus as recited in claim 1, further including:

a first hand grip connected to a respective pair of said strut members associated with said first curvilinear elements; and a second hand grip connected to a respective pair of said strut members associated with said second curvilinear elements.

4. A walker apparatus as recited in claim 1, wherein said stabilization and movement means includes:

two roller elements, one of said roller elements being connected to said first curvilinear element of said lowermost ring member proximate said axial member and the other of said roller elements being connected to said second curvilinear element of said lowermost ring member proximate said axial member; and two frictional skid elements, each connected to a respective curvilinear element of said lowermost ring member nearer to the ends thereof opposite said roller elements.

* * * * *